US005450497A

United States Patent [19]

Paddock

[11] Patent Number: 5,450,497

[45] Date of Patent: Sep. 12, 1995

[54] AUDIO TRANSDUCER IMPROVEMENTS

[75] Inventor: Paul W. Paddock, McMinnville, Oreg.

[73] Assignee: Linaeum Corporation, Portland, Oreg.

[21] Appl. No.: 882,144

[22] Filed: May 11, 1992

[51] Int. Cl.[6] ..... H04R 25/00

[52] U.S. Cl. ..... 381/191; 381/202; 381/186

[58] Field of Search ..... 381/202, 194, 196, 190, 381/191, 116, 113, 174, 173, 186, 182; 310/324; 181/163, 164, 168, 169

[56] References Cited

U.S. PATENT DOCUMENTS

| | | | |
|---|---|---|---|
| 1,821,469 | 9/1931 | Hicks | 181/169 |
| 3,890,511 | 6/1975 | Haugsjaa et al. | 381/191 |
| 4,006,312 | 2/1977 | Freeman | 381/191 |
| 4,076,980 | 2/1978 | Arnold et al. | 73/152 |
| 4,356,049 | 10/1982 | Tamura et al. | 381/191 |
| 4,440,983 | 4/1984 | Facoetti et al. | 381/190 |
| 4,584,439 | 4/1986 | Paddock | 179/115.5 |
| 4,887,300 | 12/1989 | Erling | 381/191 |
| 4,903,308 | 2/1990 | Paddock et al. | 381/202 |

FOREIGN PATENT DOCUMENTS

| | | | |
|---|---|---|---|
| 1129183 | 5/1962 | German Dem. Rep. | 381/191 |
| 0004228 | 1/1977 | Japan | 381/196 |
| 0244199 | 12/1985 | Japan | 381/191 |
| 0290399 | 11/1990 | Japan | 381/190 |
| 0272377 | 6/1970 | U.S.S.R. | 381/191 |

*Primary Examiner*—Curtis Kuntz
*Assistant Examiner*—Huyen D. Le
*Attorney, Agent, or Firm*—Klarquist Sparkman Campbell Leigh & Whinston

[57] ABSTRACT

An audio transducer having a cylindrical diaphragm molded with contoured ridges. The diaphragm includes at least two lobes, each extending from a central expanse to the transducer frame. The lobes may have different radii and different angular arc lengths. A driver attached at the central expanse may include a double-sided etched coil, or may be provided by an electrostatic driver having a charged filament attached to the diaphragm. The transducer diaphragm may include a central third lobe having different size and structural characteristics to provide added low frequency response. The transducer may be configured to provide omnipolar sound radiation with opposed spaced-apart semi-circular cylindrical diaphragms arranged to pulse symmetrically toward and away from each other.

5 Claims, 10 Drawing Sheets

AUDIO TRANSDUCER IMPROVEMENTS

TECHNICAL FIELD

This invention generally relates to audio transducers. More particularly, the invention relates to improvements in the design of a transducer having a cylindrical or partially cylindrical arcuate diaphragm defined by a cross-sectional profile projected on an axis to define a generally cylindrical diaphragm.

BACKGROUND OF THE ART

U.S. Pat. Nos. 4,584,439 and 4,903,308, and pending U.S. patent application Ser. Nos. 07/499,492 filed Mar. 29, 1990; 07/436,914 filed Nov. 14, 1989; 07/708,924 filed Apr. 11, 1991; and 07/730,172 filed Jul. 12, 1991, are incorporated herein by reference, as they disclose variations and refinements of an audio transducer having a diaphragm that can be generally described as "cylindrical" in the broadest sense of the term. That is, the diaphragm is defined by a two-dimensional cross-sectional profile that is projected on an axis to form a three-dimensional diaphragm having a constant cross-section. The cross-sectional profile need not be circular but may be an open or closed polygon or curve. These cylindrical diaphragms may generally be formed from flat sheets that are curved so that all lines normal to the curved surface remain perpendicular to the axis of projection. The diaphragms in the disclosed patents typically include a pair of tangentially abutting circular or semi-circular cross-sectional tube-shaped webs.

In operation, these cylindrical diaphragm transducers generate sound by a "rolling motion" in which an electromagnetic coil attached to the diaphragm interacts with a fixed magnetic field to move in a direction perpendicular to the axis of projection of the diaphragm. Each of various portions of the diaphragm accommodate the coil motion relative to a fixed frame by selectively tightening and loosening its radius of curvature to achieve the rolling motion.

While the transducers of the above-referenced applications and patents are reasonably efficient, with a relatively flat frequency response over a large bandwidth of approximately 5 octaves, there remains a need for additional improvements in the performance criteria of efficiency, bandwidth and response flatness. In addition, there is a need to reduce manufacturing costs and to further increase product quality by simplifying the manufacture of such a device.

SUMMARY OF THE INVENTION

The primary object of this invention is to provide an improved transducer having features that independently and in concert overcome the difficulties and shortcomings of the prior art and which fulfills the aforementioned needs.

This object may be satisfied by providing a transducer having a cylindrical diaphragm and one or more of the following improvements: an asymmetric or unbalanced diaphragm, a monopolar diaphragm, an S-shaped diaphragm, opposed and spaced-apart diaphragm webs for omnipolar output, an etched coil, an electrostatic drive element, a three-lobed diaphragm, and molded contoured diaphragms with stiffening ridges.

DETAILED DESCRIPTION OF THE INVENTION

Figure 1:
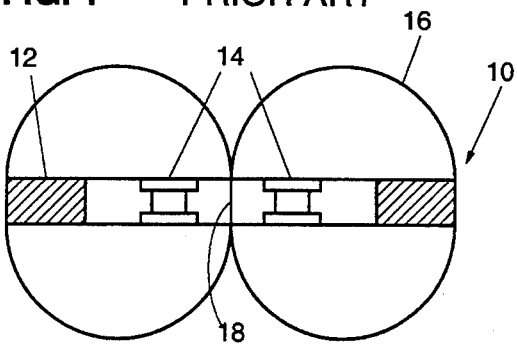
FIG. 1 PRIOR ART
FIG. 1 is a sectional schematic top view of a prior art transducer.

FIG. 1 illustrates a schematic cross-sectional view of a prior art transducer illustrated in FIG. 1 of U.S. Pat. No. 4,903,308 to Paddock et al. The prior art transducer 10 includes a rigid frame 12 carrying magnets 14. A symmetrical two-lobed "figure-eight" shaped diaphragm 16 has two intercoupled circular sections tangentially abutting at a central expanse 18 that carries an electromagnetic coil. In this schematic view, the diaphragm is viewed along its axis of projection to show its cross-sectional profile. The remote ends of each web are connected to opposite ends of the frame 12. The transducer 10 is bilaterally symmetrical, giving it predictable and balanced acoustic properties. However, any acoustic faults in any one portion of the diaphragm are thus likely to occur in corresponding symmetrical portions, with the undesirable consequences of such faults being magnified multi-fold.

It will be appreciated that unless otherwise specified, the actual construction details of the prior art transducer of FIG. 1 and transducer designs described below are identical to what is disclosed in U.S. Pat. No. 4,903,308. Additional information for constructing these transducer designs can be found in U.S. Pat. No. 4,584,439.

Figure 2:
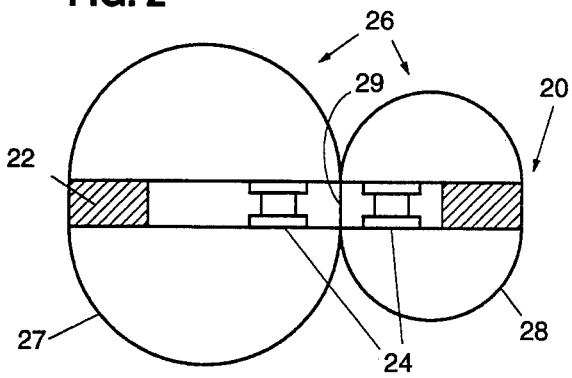
FIG. 2 is a sectional schematic top view of a transducer having an asymmetric diaphragm in accordance with one embodiment of the present invention.

FIG. 2 shows an asymmetric transducer 20 having a frame 22, magnets 24 secured to the frame, and an asymmetrical "figure-eight" shaped diaphragm 26 secured at its remote ends to the frame. One generally circular first lobe 27 of the diaphragm 26 is larger than an adjacent smaller second lobe 28, with the lobes tangentially abutting at a central expanse 29 between the magnets 24. The two lobes are interconnected at the central expanse. While the asymmetric diaphragm 26 may be formed of a single uniform material, it is preferred that the two lobes be formed of materials having different thicknesses and flexibility properties. Because of spring forces in the diaphragm, it tends to return to a centered position in the absence of external forces. Preferably, the lobes have similar spring constants to provide a net balanced spring force, and so that the central expanse naturally follows a straight path during the rolling motion of the diaphragm. This may be achieved by selecting a thicker and stiffer material for the larger first lobe 27 than for the smaller second lobe 28. Alternatively, the entire diaphragm may be formed of a single sheet of material with molded stiffening ridges to provide needed rigidity, as will be discussed below. The diaphragm preferably is provided with damping means such as damping strips adhered to the inner concave surface of the diaphragm (as shown in the '308 patent) or alternative damping means as described below.

Figure 3:
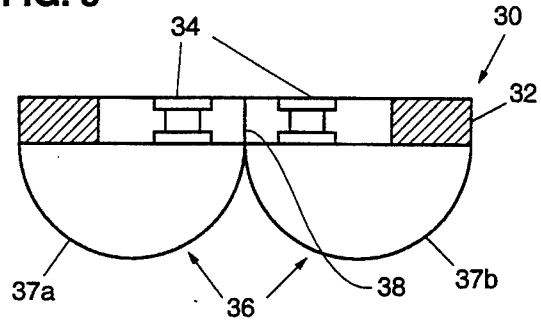
FIG. 3 is a sectional schematic top view of a symmetrical monopolar transducer in accordance with a second embodiment of the present invention.

FIG. 3 shows a monopolar transducer 30 having a frame 32 carrying magnets 34 and having a flexible cylindrical diaphragm 36 attached to the frame. The diaphragm 36 is formed in a "numeral-three" profile with a pair of semi-circular lobes **37*a*, 37*b* attached at their distal ends to the frame and tangentially abutting at a central expanse 38 disposed between the magnets 34. The transducer 30 is a monopolar design and generates sound from only one side, so that it may be attached to a large flat surface, such as a wall or the front of a speaker cabinet (not shown), with the convex lobes projecting away from the surface. Because of the inherent tendency of the semi-circular lobes of the diaphragm 36** to straighten out, the lobes are securely glued together at the central expanse so that the diaphragm retains its shape while at rest. Also, the lobes may be preformed in the curved state so that they remain curved when unstressed.

Figure 4:
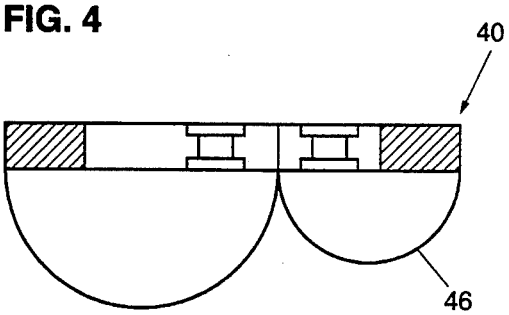
FIG. 4 is a sectional schematic top view of an asymmetric monopolar transducer in accordance with a third embodiment of the present invention.

FIG. 4 shows a transducer 40 having a "numeral-three" shaped diaphragm 46 similar to that of diaphragm 36 shown in FIG. 3, but with asymmetrically shaped lobes. Consequently, the transducer achieves the advantages of asymmetry in a monopolar design.

Figure 5:
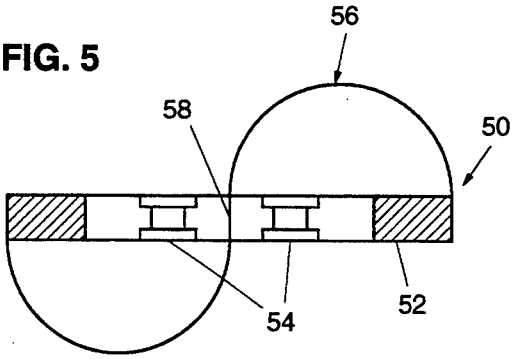
FIG. 5 is a sectional schematic top view of a transducer having a balanced S-shaped diaphragm in accordance with a fourth embodiment of the present invention.

FIG. 5 shows a transducer 50 having a frame 52 with magnets 54 attached to the frame. A substantially S-shaped diaphragm 56 attached to the frame has two substantially semi-circular lobes, with each lobe being convex outward away from opposite sides of the frame. The lobes are joined at a central expanse 58 between the magnets 54. Because of the inherent tendency of an S-shaped diaphragm to straighten out to a flattened state, the diaphragm 56 is preferably molded to its desired S-shape so that it retains its shape at rest without internal stresses. In contrast to the diaphragms previously described, the diaphragm 56 may be constructed of a continuous single sheet or multi-layer sheet which forms both lobes, rather than two separate and distinct sheets (multi-layer or otherwise) which are interconnected at the central expanse to form the two lobes.

Figure 6:
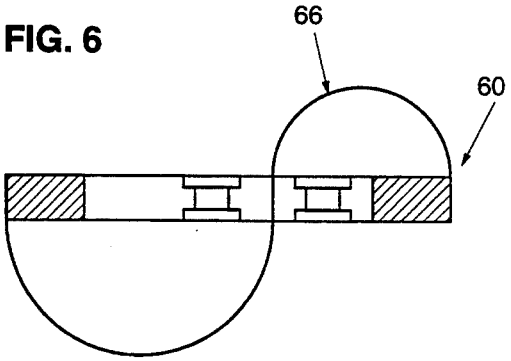
FIG. 6 is a sectional schematic top view of a transducer having an unbalanced S-shaped diaphragm in accordance with a fifth embodiment of the present invention.

FIGS. 6–9 illustrate variations of the S-shaped diaphragm. FIG. 6 shows a transducer 60 having a substantially S-shaped diaphragm 66 with lobes of different sizes analogous to the asymmetrical transducers shown in FIGS. 2 and 4.

Figure 7:
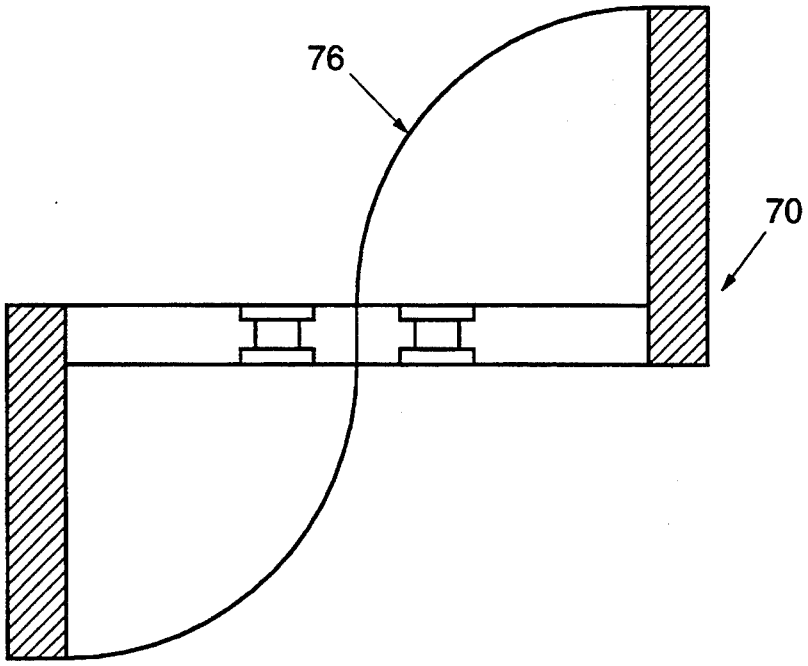
FIG. 7 is a sectional schematic top view of a transducer having a balanced truncated S-shaped diaphragm in accordance with a sixth embodiment of the present invention.

FIG. 7 shows a transducer 70 having a substantially S-shaped diaphragm 76 in which each lobe forms a quarter circle, as opposed to the semi-circular lobes illustrated in FIG. 5. The transducer 70 has some similarity to the bipolar transducer disclosed in U.S. Pat. No. 4,584,439 to Paddock.

Figure 8:
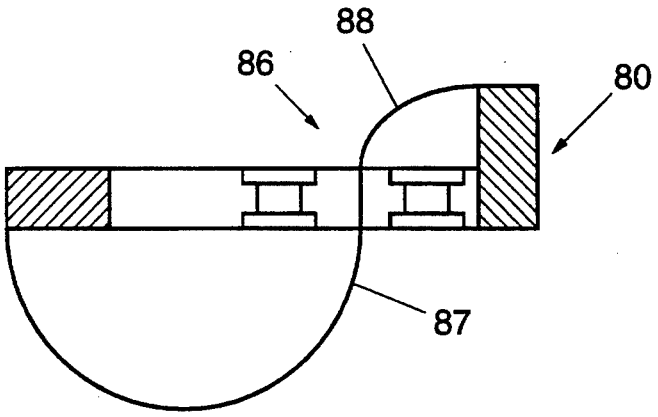
FIG. 8 is a sectional schematic top view of a transducer having an unbalanced partially truncated S-shaped diaphragm in accordance with a seventh embodiment of the present invention.

FIG. 8 shows a transducer 80 having a generally S-shaped diaphragm 86 with a forward-facing semi-circular lobe 87 having a first radius and a rearward facing quarter-circle lobe 88 having a second radius smaller than the first radius. As discussed above with respect to the asymmetrical transducer of FIG. 2, the different lobes are preferably formed of materials having different stiffness and other mechanical properties to achieve a balanced rolling motion.

Figure 9:
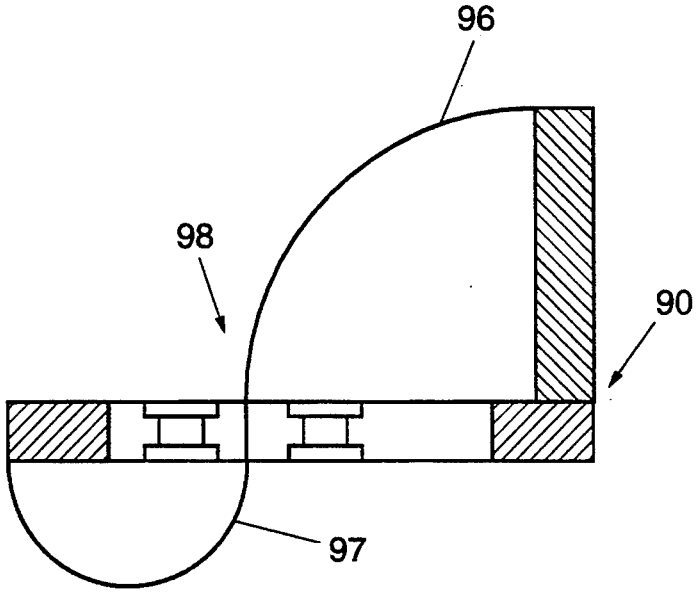
FIG. 9 is a sectional schematic top view of a transducer having an unbalanced partially truncated S-shaped diaphragm in accordance with an eighth embodiment of the present invention.

FIG. 9 shows a transducer 90 having an S-shaped diaphragm 96 similar to that of FIG. 8, except that it has a semi-circular front lobe 97 with a radius smaller than a quarter-circle rear lobe 98. It is also contemplated that the embodiments of FIGS. 8 and 9 may be rotated by 180 degrees so that the quarter-circle lobe of either embodiment faces forward.

Figure 10:
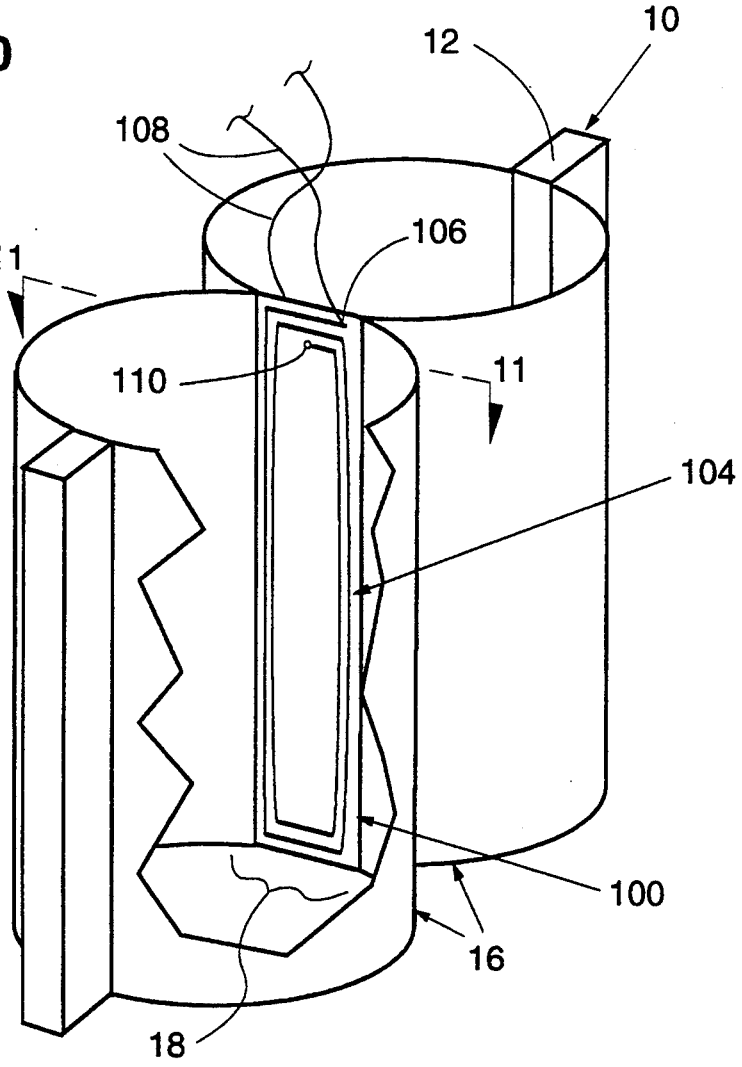
FIG. 10 is a fragmentary perspective view of a transducer having an etched coil in accordance with a ninth embodiment of the present invention.
Figure 11:
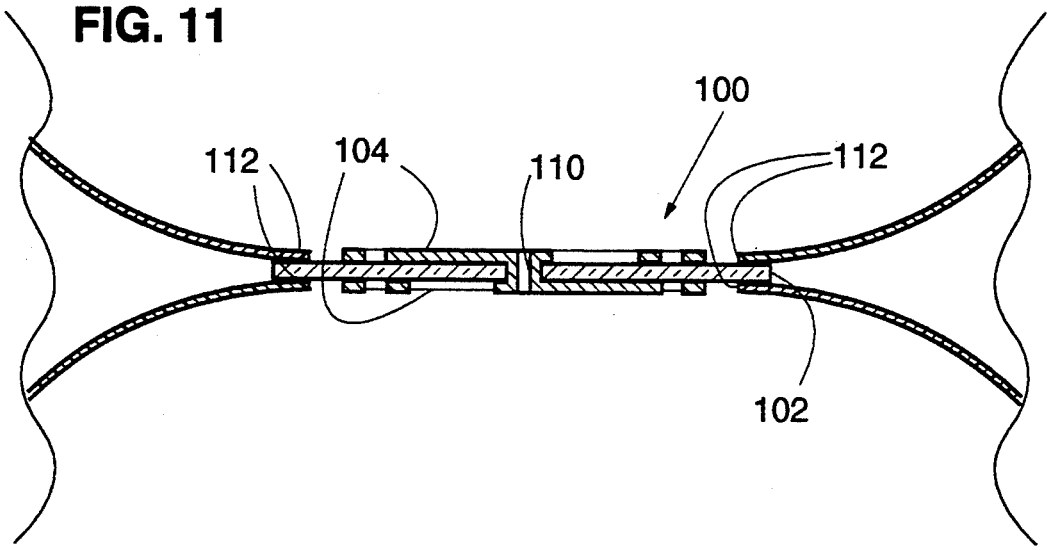
FIG. 11 is an enlarged cross-sectional view taken along line 11—11 of FIG. 10.

FIG. 10 shows a modified version of the transducer 10 of FIG. 1, with an etched coil assembly 100 attached to the diaphragm 16 at the central expanse 18. These modifications may be employed in any of the diaphragm profiles disclosed or suggested above. As shown in FIG. 11, the coil assembly 100 is formed in a multi-layer laminated design like that used for production of conventional two-sided printed circuit boards. A thin substrate 102 formed of a glass epoxy material or others such as Kapton common to printed circuit boards includes a pair of conductive coils 104 etched from copper foil laminated to opposite sides of the substrate 102. The substrate may range upward from 0.0025 inch thick, with 0,005 inch being preferred. One ounce copper foil provides adequate current carrying capacity, with trace widths of between 0,004–0,010 inch for the long vertical traces; the short transverse traces may be somewhat wider. Overall impedance of the coil may be varied by adjusting the width of the transverse traces. In the preferred embodiment, each coil is capable of carrying 2 amps of current continuously. Because the assembly is commonly fabricated for very stressful manufacturing processor, it is not susceptible to delamination at temperatures that occur in an audio transducer environment.

Each coil 104 includes a trace end contact 106 suitable for attachment to wiring 108 (shown in FIG. 10) that connects to an amplifier output. A metallized through-hole 110 defined in the substrate 102 permits the connection of the inner terminus of one coil to the inner terminus of the other coil on the opposite side of the substrate. As a result, there is no need for lead wires to provide a crossover for connecting to the interior of the coil. Also, the number of turns is effectively doubled, with the current flowing in one orbital direction. The coil assembly 100 is preferably adhered to inner diaphragm edges 112 as shown in FIG. 11 to allow the coils 104 to remain exposed to air for heat dissipation. The etched coil assembly may also be used in conjunction with any of the asymmetrical, S-shaped or monopolar embodiments shown in FIGS. 2 through 9.

Figure 12:
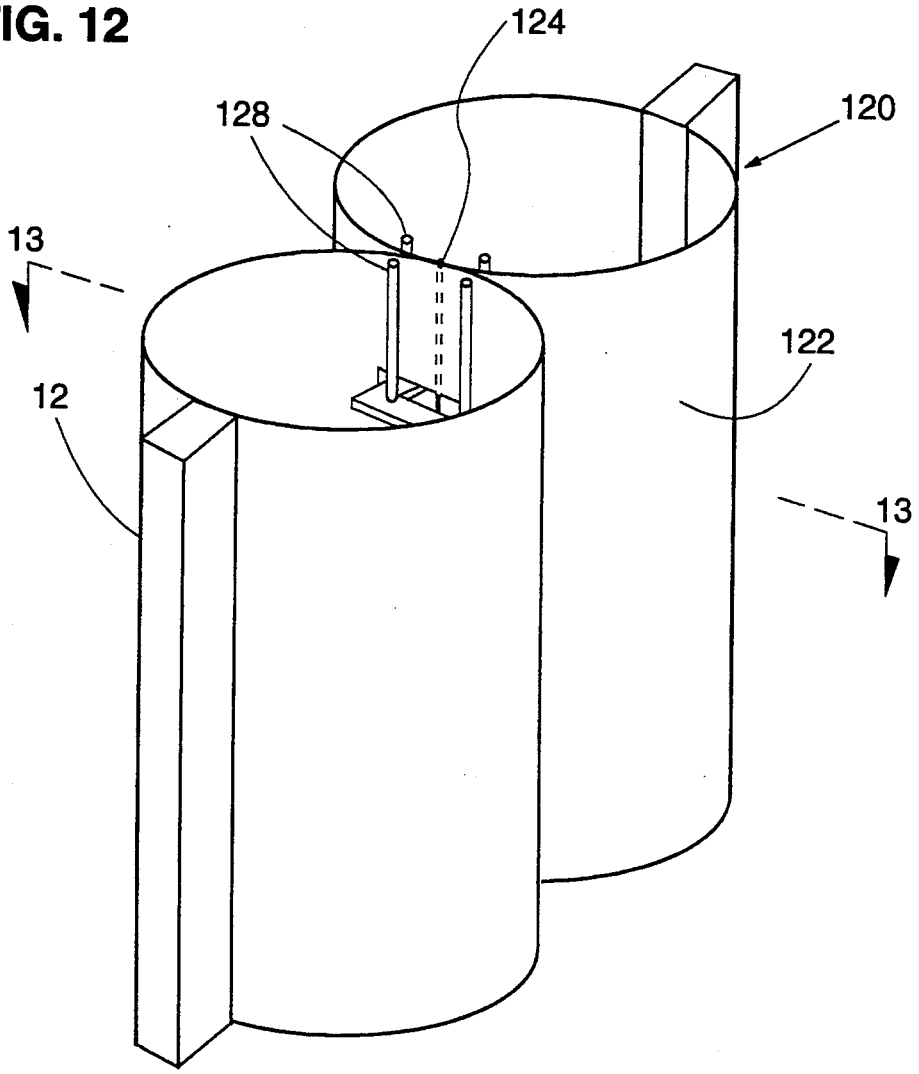
FIG. 12 is a perspective view of an electrostatic transducer having a cylindrical diaphragm in accordance with a tenth embodiment of the present invention.

FIG. 12 shows an electrostatic transducer 120 having a cylindrical diaphragm 122 with a substantially "figure-eight" profile, similar to the prior art transducer 10 shown in FIG. 1. The electromagnetic drive system of the prior art device is replaced by an electrostatic drive. In the electrostatic transducer 120 of FIG. 12, a highly charged filament 124 is attached to the diaphragm at the central expanse and runs the full height of the diaphragm without interruption. The filament is electrically connected to a high voltage of about 2–10 kv, and remains constantly charged during operation. A set of conductive rods 128 is fixed to the transducer frame 12 and connected to the variable signal outputs of an amplifier 129. The charged filament 124 is thereby electrostatically attracted to and repulsed by the variably charged rods with a force sufficient to create motion in the diaphragm for generating sound.

Figure 13:
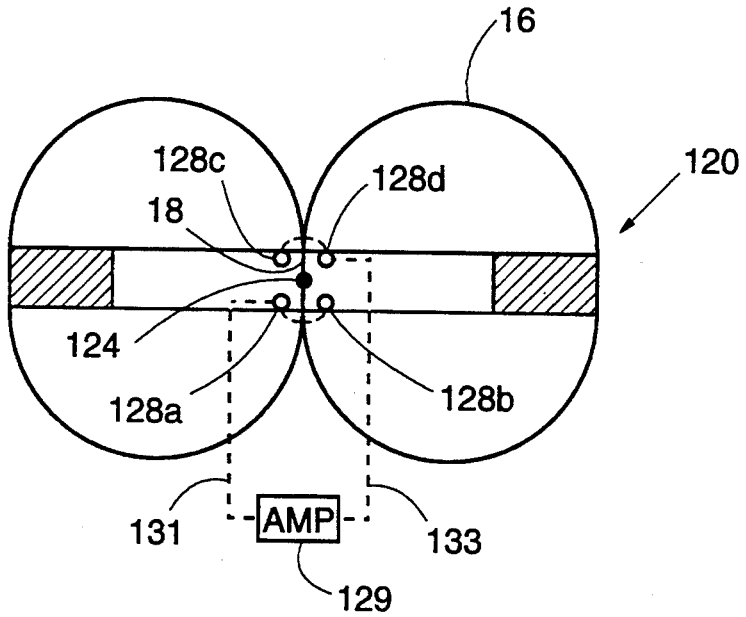
FIG. 13 is a schematic cross-sectional top view taken along line 13—13 of FIG. 12.

FIG. 13 shows the electrostatic transducer 120 in cross-section. To achieve a balanced, controlled diaphragm motion, the drive rods 128 are arranged in a rectangular array. Each drive rod runs parallel to the projection axis of the diaphragm 16. A left front drive rod **128*a* and right front drive rod 128*b* are positioned adjacent the central expanse 18 on opposite sides thereof and generally forward of the filament 124. The front drive rods 128*a* and 128*b* are electrically connected together and are connected to a first amplifier output line 131. A left rear drive rod 128*c* and right rear drive rod 128*d* are similarly positioned on opposite sides of the central expanse, but to the rear of the filament 124. The rear drive rods 128*c* and 128*d* are electrically connected to each other and to a second amplifier output line 133**, with the amplifier being connected to an input signal and creating a variable potential voltage difference between the front and rear drive rod pairs.

The charged filament 124 is preferably sandwiched between the tangentially abutting diaphragm lobes. In embodiments having S-shaped diaphragm profiles, such as those shown in FIGS. 5–9, the filament may be attached to one side of the diaphragm or laminated between layers of a multi-layer diaphragm.

Figure 14:
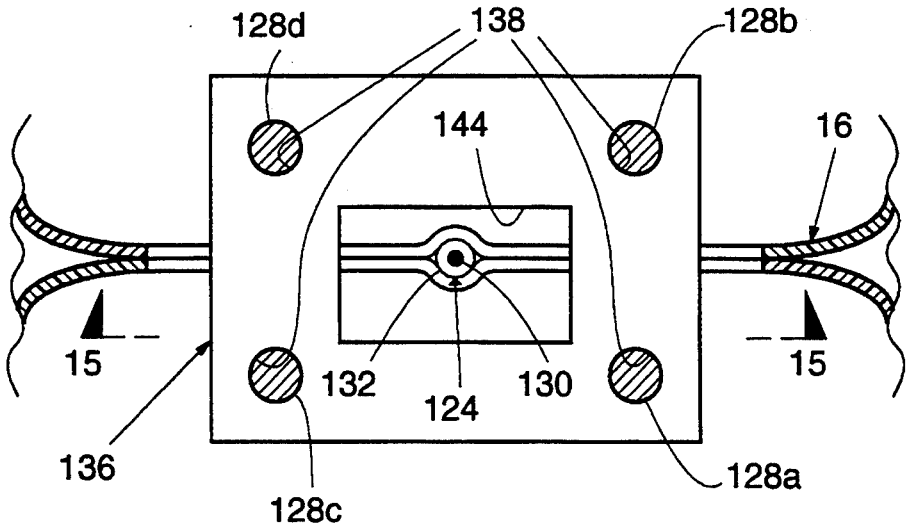
FIG. 14 is an enlarged partial cross-sectional view taken along line 13—13 of FIG. 12.

As shown in FIG. 14, the filament 124 includes a conductive core 130 surrounded by an insulating cladding layer 132. The core is preferably formed of graphite-impregnated thread or other electrically conductive material to retain a charge. The cladding layer 132 is preferably formed of a thin tube of glass or other dielectric material that is not susceptible to dielectric breakdown at high voltages in the range of up to 5–10 kv. Without the cladding layer, the conductive core would be susceptible to arcing at high voltage, leading to ozone generation and other related problems. While a voltage of 2 kv may be adequate to achieve acceptable performance, higher voltages will provide commensurate increases in speaker efficiency, reducing amplifier cost and power requirements.

As shown in FIG. 14, one or more rod retention clips 136 may be used to laterally interconnect rods **128*a*, 128*b*, 128*c*, 128*d*. The clip 136 is formed of insulating material, such as a resilient plastic, to mechanically align the rods 128 and to eliminate unwanted vibrations thereof. The clip 136 defines a set of rod apertures 138 through which rods 128*a–d* are received.. The clip defines a central space 144 for receiving the charged filament 124 and to permit a range of motion. Because the clip completely encircles the charged filament, the filament must be threaded through each clip prior to lamination with the diaphragm. Alternatively, the clip may be U-shaped so that it may be installed after the filament is laminated with the diaphragm and may further include flexible snap connections for receiving the rods without requiring the rods to be threaded through the apertures 138**. To prevent vibration and loosening, the rods are preferably adhesively attached to the clip after assembly.

Figure 15:
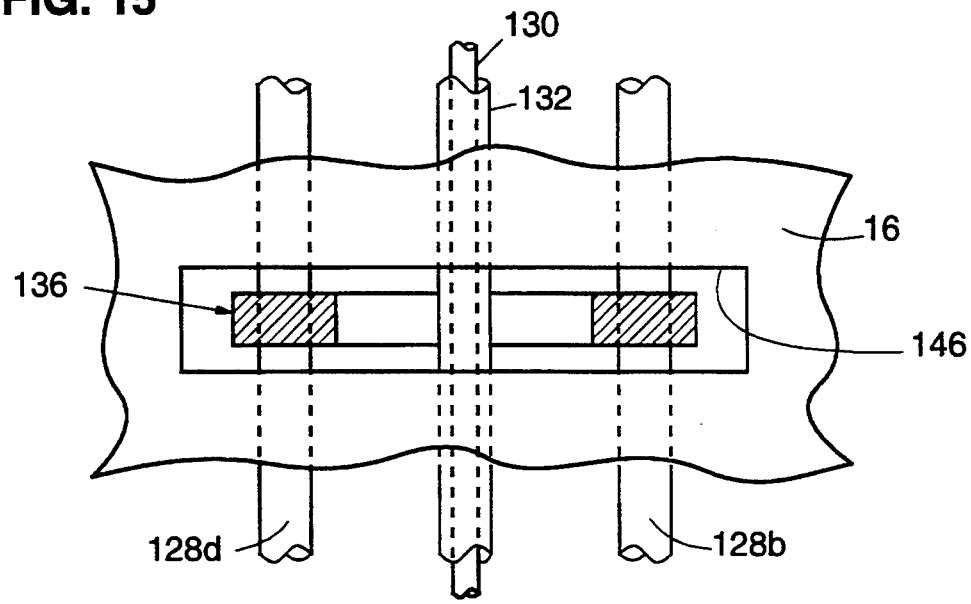
FIG. 15 is an enlarged cross-sectional view taken along line 15—15 of FIG. 14.

FIG. 15 further shows the clip 136 in a vertically aligned relationship with the diaphragm 16. The diaphragm defines an oblong or rectangular aperture 146 that is sufficiently large to provide clearance for the clip 136 and so that the diaphragm may vibrate in a sufficiently wide range of motion to generate sound without contacting the clip.

Figure 16:
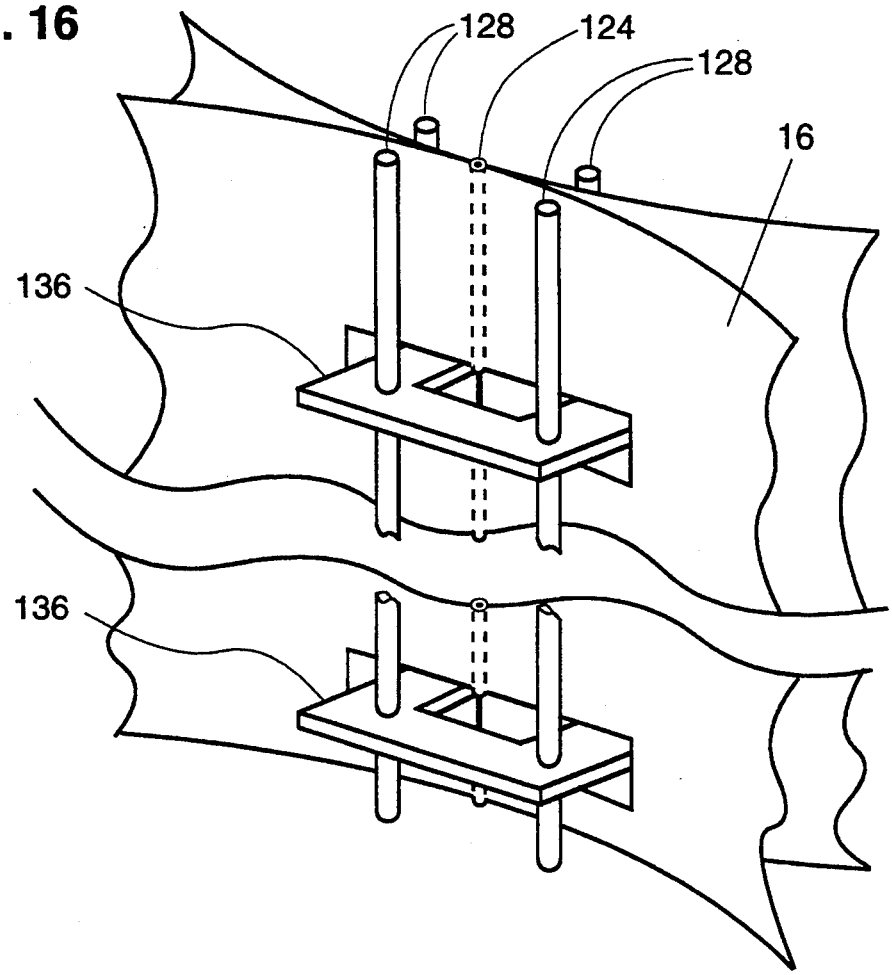
FIG. 16 is an enlarged fragmentary perspective view of the electrostatic drive portion of the transducer of FIG. 12.

FIG. 16 shows a central portion of the diaphragm 16 in which two clips 136 are attached to rods **128*a*, 182*b*, 128*c*, 128*d*** to provide alignment. This approach is useful for very tall transducers, an application to which the electrostatic approach is particularly well suited. Many clips are employed in a tall transducer, with the clips being spaced apart by 3 to 6 inches. An electromagnetic coil driven speaker of this type suffers from increasing impedance as the coil length is extended. Thus, a transducer several feet tall must be manufactured in several distinct sections. However, the electrostatic transducer has no such limitations.

Figure 17:
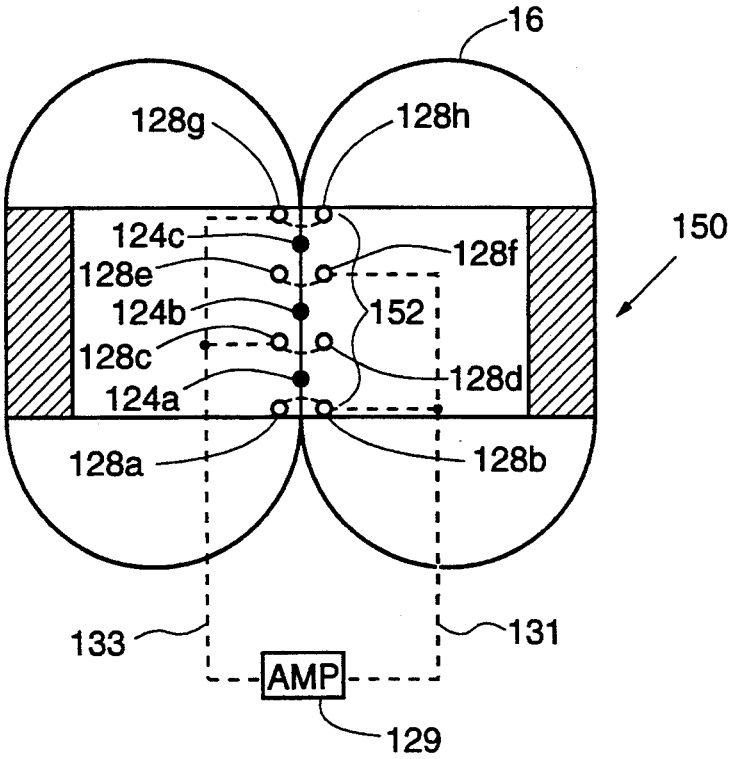
FIG. 17 is a schematic cross-sectional top view of an electrostatic transducer having multiple drive elements in accordance with an eleventh embodiment of the present invention.

FIG. 17 shows an electrostatic transducer 150 using ganged components for improved efficiency. The transducer 150 has three charged filaments **124*a*, 124*b* and 124*c* mounted on an enlarged central expanse 152 of the diaphragm 16. Drive rods 128*a*–128*h* are arranged in pairs in alternation with the filaments, with the members of each pair being positioned in opposite sides of the central expanse 152. So that all of the components act in concert to provide efficient, high output sound, the central filament 124***b* is charged to a high voltage polarity opposite that of filaments 124*a* and 124*c*. Drive rods 128*a*, 128*b*, 128*e* and 128*f* are connected to a first output 131 of amplifier 129; rods 128*c*, 128*d*, 128*g* and 128*h* are connected to the opposite amplifier output 133. The ganged approach illustrated in FIG. 17 is shown as having three filaments, but it is contemplated that this number may be two, four or more.

The electrostatic drive construction is illustrated in conjunction with a symmetrical bipolar "figure-eight" profile diaphragm, as shown in FIGS. 1–13. However, the electrostatic principle may be applied to any transducer having a cylindrical diaphragm, such as those illustrated in FIGS. 2–9. The ganged construction illustrated in FIG. 17 has a similarly wide applicability and need not be limited to the illustrated embodiment.

Figure 18:
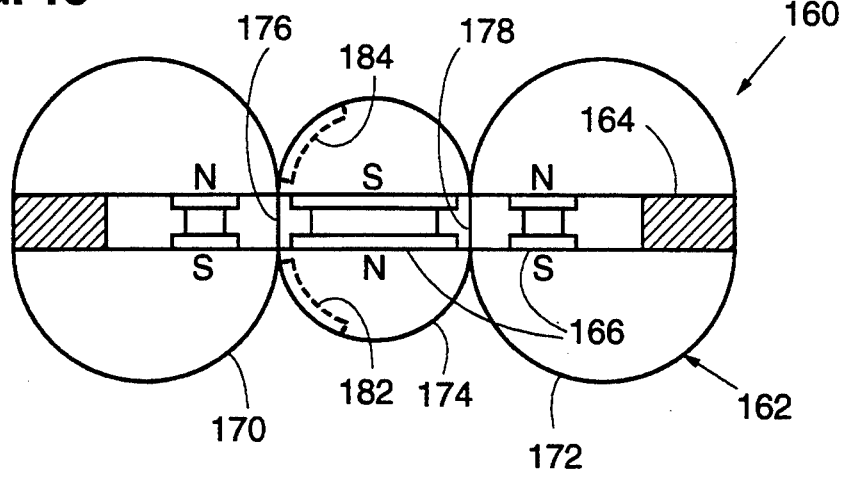
FIG. 18 is a schematic cross-sectional top view of a low frequency transducer having three cylindrical diaphragm lobes in accordance with a twelfth embodiment of the present invention.

FIG. 18 shows a low range transducer 160 having a three-lobed diaphragm 162. The transducer 160 includes a frame 164 supporting three sets of magnets 166. The diaphragm 162 includes two primary peripheral lobes 170, 172 formed of a flexible material, as used in two-lobed diaphragms of the prior art. A central lobe 174 has a smaller radius than the peripheral lobes 170, 172 and tangentially abuts each peripheral lobe at a respective central expanse 176, 178 that carries a coil for production of sound generally in the manner disclosed in the prior art. With the peripheral magnets being oriented in similar polarity and the central magnets oriented oppositely, the coils attached to each central expanse 176, 178 are connected in opposite polarity so that both coils act in concert to create a synchronized driving motion.

The transducer 160 may be configured as a woofer for producing primarily low frequency sounds, or alternatively may serve as a wide bandwidth device with a frequency range extending to substantially lower frequencies than would be possible with a two-lobed diaphragm.

For use as a woofer only, the central lobe material may be a relatively heavy and stiff material for maximum efficiency. The central area behaves as a piston and generates low frequency sound in concert with the peripheral lobes 170, 172, which operate in a rolling motion, as described in the prior art. Because the central lobe 174 functions ideally as a piston, wave motion across the central lobe is undesirable and may be controlled through use of a damping material such as felt, which may be attached to the entire inner surface of the central lobe 174.

For the transducer 160 to function as a wide bandwidth device, the central lobe 174 is formed of a thin, flexible material that may be appreciably thinner than the flexible material forming the peripheral lobes 170 and 172. Such a thin material will be sufficiently rigid at low frequencies due to the tighter radius in which it is bent. At low frequencies, the full range transducer 160 operates essentially as the woofer embodiment discussed above. At high frequencies, the central lobe responds flexibly to wave motion. Accordingly, the central lobe 174 must be damped adjacent to one central expanse 176 by a pair of felt strips 182, 184 attached to the interior of the central lobe 174. Without such damping, each central expanse would function as a separate sound source with the sound generated by each objectionably interfering with that generated by the other. Alternatively, to avoid interference, the input to one of the coils may be electronically filtered to eliminate interference-generating high frequencies.

Figure 19:
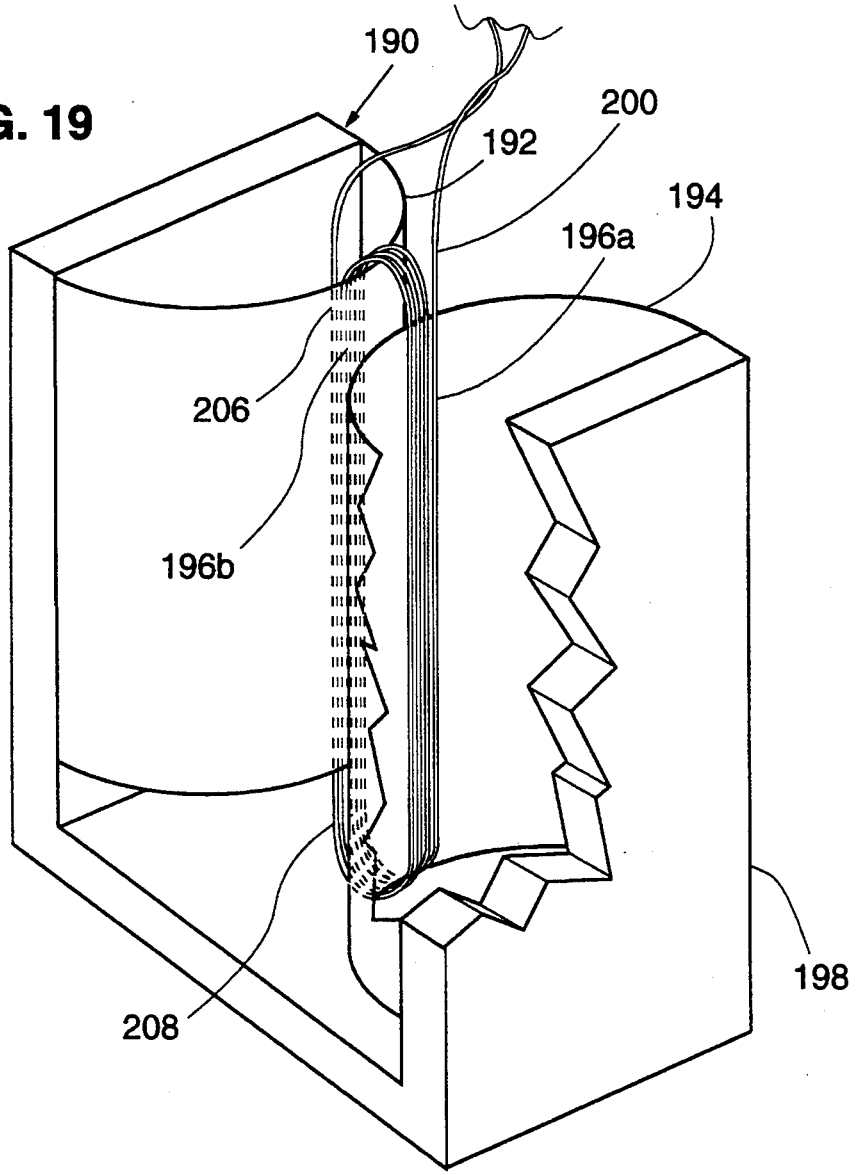
FIG. 19 is a fragmentary perspective view of an omnipolar transducer in accordance with a thirteenth embodiment of the present invention, with magnet means omitted.

FIG. 19 shows a compression omnipole wave generator transducer 190 having opposed semi-cylindrical diaphragms 192, 194 with opposed, central coil-carrying portions 196*a*, 196*b*. Distal edge portions of the diaphragms are mounted to a frame 198. An electromagnetic coil 200 is attached to the diaphragm and forms a series of adjacent loops, each one of which runs up the first diaphragm 192 and down the second diaphragm 194. Accordingly, at any given time, all current flowing through the coil is flowing in a single direction in the wire portions of the coil 200 attached to the first diaphragm 192, while the current is flowing in the opposite direction through all the wire portions of the coil attached to the second diaphragm 194.

Figure 20:
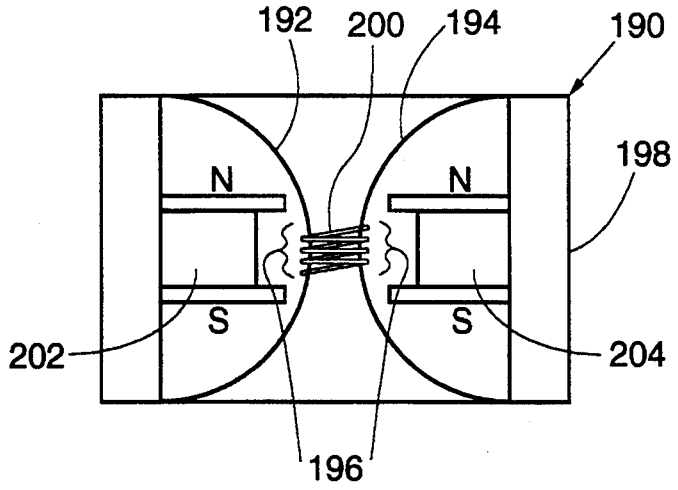
FIG. 20 is a cross-sectional schematic top view taken along line 20—20 of FIG. 19.

FIG. 20 shows a cross-sectional schematic view of the omnipole transducer 190, which has magnets 202, 204 attached to the frame 198 within the respective diaphragms 192, 194. The magnets are oriented in similar polarity so that the north pole of the first magnet 202 is directly opposite the north pole of the second magnet 204, with the south poles being similarly opposed. While the coil 200 is securely adhered to the diaphragms where the vertical wire portions run adjacent the magnet structures, the coil 200 includes slack upper and lower loops 206, 208 to permit the central coil-carrying portions 196 of the diaphragm freely to move toward and away from each other as a varying current passes through the coil.

Figure 21:
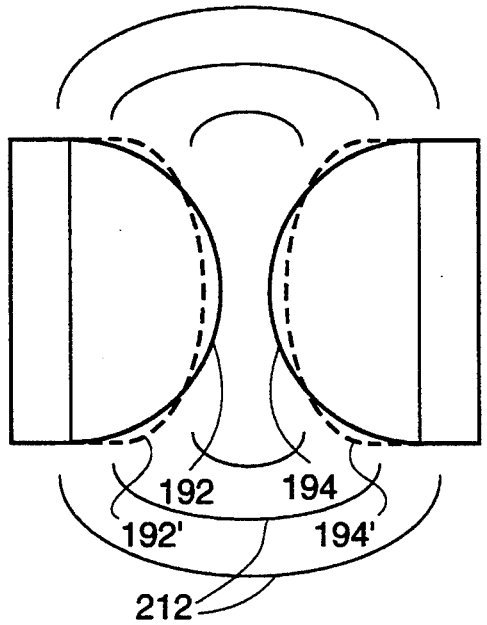
FIG. 21 is a top schematic view of the transducer of FIG. 19 showing the operation thereof.

In FIG. 21, the diaphragms 192, 194 (shown in solid lines) are shown in the extended position more closely spaced than when in the flexed positions 192', 194' (shown in dashed lines). This opposed motion creates compression and rarefaction of air within the space between the diaphragms. Consequently, acoustic waves 212 are emitted from the space between the diaphragms in a widely dispersed pattern on each side of the transducer. The combination of the acoustic waves, which constructively interact with each other as they emanate from the front and rear, gives the transducer an omnipolar response. In other words, the sound pressure generated by the transducer in a response to a given signal does not appreciably vary as the listener moves in a horizontal 360 degree circle centered on the transducer. The transducer 190 may be constructed in a vertically elongated configuration to create an effective omnipolar line source, that is, one that emulates a theoretical radially-pulsing cylinder.

Figure 22:
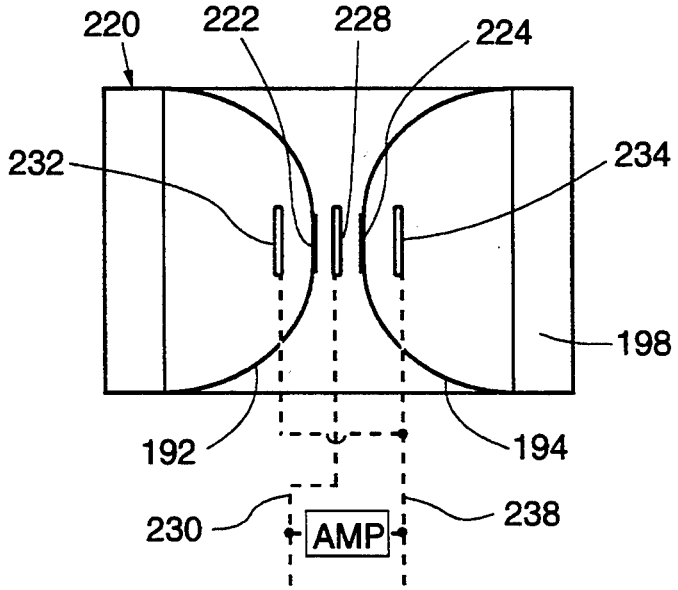
FIG. 22 is a schematic cross-sectional top view of an omnipolar transducer having an electrostatic drive in accordance with a fourteenth embodiment of the present invention.

Alternatively, as shown in FIG. 22, an electrostatic omnipole transducer 220 may be constructed according to the principles of the electrostatic transducer of FIG. 13. The electrostatic omnipole transducer 220 has similarly charged planar elements 222, 224 attached respectively to diaphragms 192, 194. The planar elements are wired to a high voltage power supply (not shown). A central plate 228 occupies the line of symmetry between the diaphragms and is connected to a first amplifier output 230. A pair of similar outer plates 232, 234 are positioned symmetrically within the respective diaphragms 192, 194 and are each electrically connected to a second amplifier output 238. The central plate 228 experiences balanced forces, making substantial reinforcement unnecessary. The outer plates 232, 234 may be secured along their height to the frame 198. Alternatively, all the plates may be replaced by similarly connected vertical rods, as shown in the embodiment of FIG. 13.

In any cylindrical diaphragm system such as those disclosed above, as well as those of the prior art, it is necessary to control the flexibility and resonances of the diaphragms. In the bipolar cylindrical transducer 10 illustrated in FIG. 1, as well as in many of the other transducers disclosed herein, a wide frequency range is achievable. However, this range is limited at the high and low ends by contrary factors.

For theoretically ideal, efficient high frequency response, the central expanse 18 should approach infinitely low mass and high rigidity so that it may move crisply and responsively to an input signal of a limited power. The distance between the central expanse 18 and the diaphragm ends attached to the frame 12 is sufficiently long compared to the wavelength of high frequency vibrations that such waves are damped within the diaphragm well before they reach the diaphragm outer edges and have an opportunity to reflect back and interfere with subsequently generated waves. Also, because the diaphragm moves only a very small amount to generate high frequencies, flexibility is not critical.

At low frequencies, on the other hand, the diaphragm moves an appreciable amount, requiring flexibility. Furthermore, the long wavelengths involved may propagate within the diaphragm to the frame and reflect back to interfere with subsequently generated waves, creating unacceptable resonances at various frequencies if left undamped. Therefore, the ideal diaphragm for producing low frequencies is thick, non-resonant and flexible. In the prior art, these contrary objectives of high- and low-frequency production have been reconciled with reasonable success because rigidity for high frequency production is essential only near the central expanse, while flexibility and wave damping is necessary only in the diaphragm regions remote from the central expanse.

Figure 23:
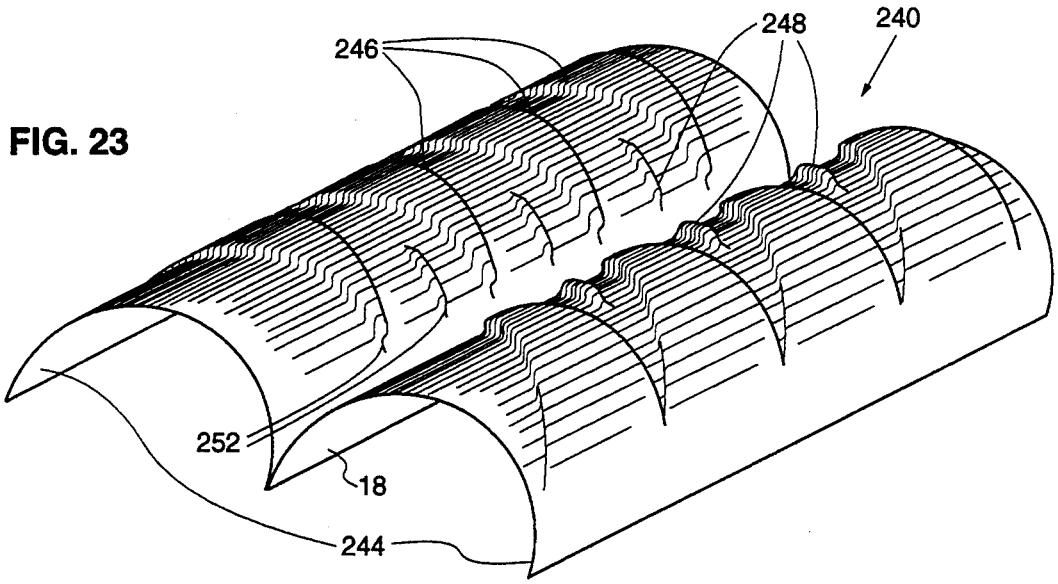
FIG. 23 is a perspective view of a molded diaphragm in accordance with a fifteenth embodiment of the present invention.

FIG. 23 shows a contoured diaphragm 240 in "numeral-three" configuration for a monopole transducer, To provide rigidity near the central expanse 18 and flexibility near the remote end 244, each lobe of the diaphragm 240 is molded from a single sheet of thermoformable plastic with a set of raised ridges 246. These ridges are broad and gently contoured near the remote end 244 to permit flexibility, and are narrow and more sharply contoured near the central expanse 18 to provide rigidity, even with a thin, otherwise flexible material. The ridges also have a taller profile near the central expanse and a lower profile near the remote end 244. Additional rigidity enhancing narrow ridges 248 may be positioned adjacent the central expanse for additional rigidity.

The contoured diaphragm 240 is preferably vacuum-formed onto a cylindrical form (not shown) shaped like the desired resulting diaphragm. This provides a diaphragm that is stress-free when at rest. If the diaphragm were formed in a generally planar position, it would become stressed as it was curved into the final cylindrical form. When so formed, it would have an outer surface in tension and inner surface in compression, resulting in different wave propagation rates.

Each ridge 246, 248 has a tapered end 252 adjacent the central expanse 18 so that waves propagating from the central expanse through the diaphragm do not appreciably reflect off the leading edge of the ridge. The ridges provide for controllability of the diaphragm's flexibility without the time-consuming and efficiency-impairing addition of mass, such as the damping strips shown in the prior art. The ridges need not have a regular or symmetrical appearance. In fact, a designer may analyze a prototype diaphragm for undesirable resonances and selectively place ridges to eliminate the resonances. For instance, a region showing excessive flexibility may be provided with narrower, taller, more rigid ridges.

Figure 24:
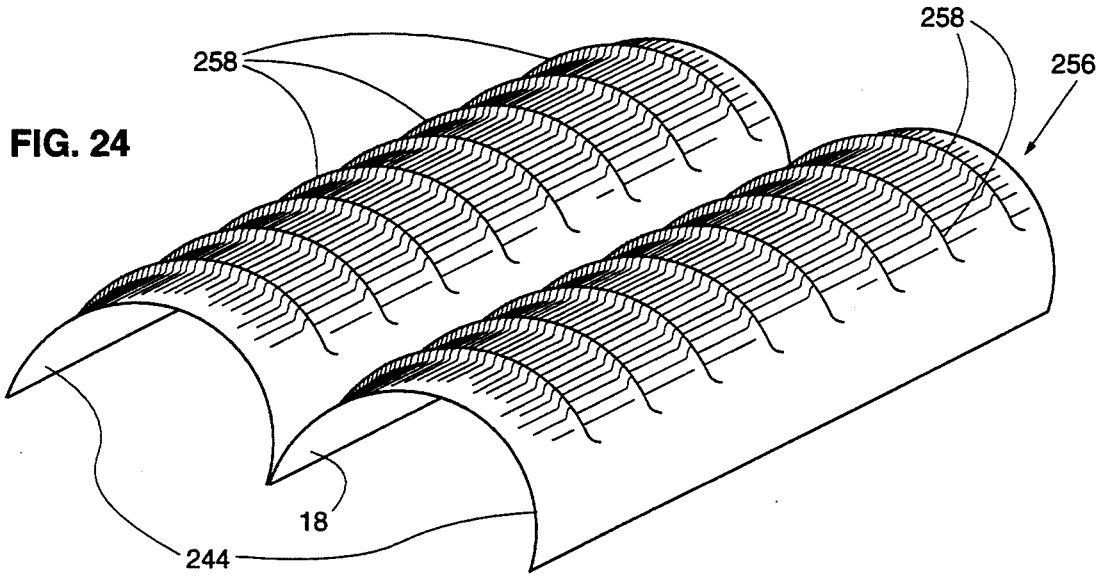
FIG. 24 is a perspective view of an alternative molded diaphragm.
Figure 25:
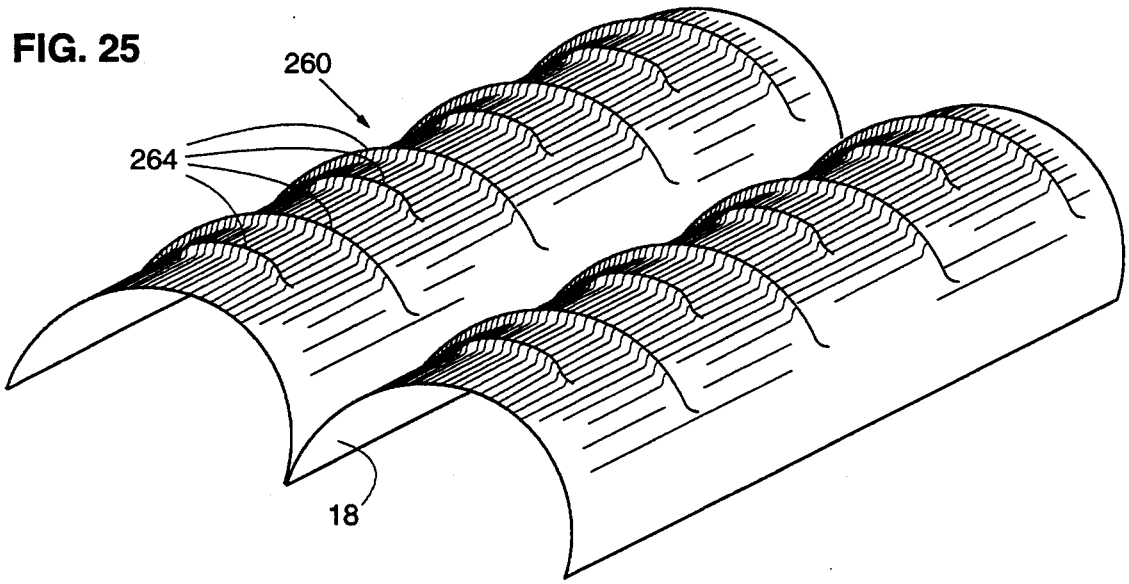
FIG. 25 is a perspective view of an alternative molded diaphragm.
Figure 26:
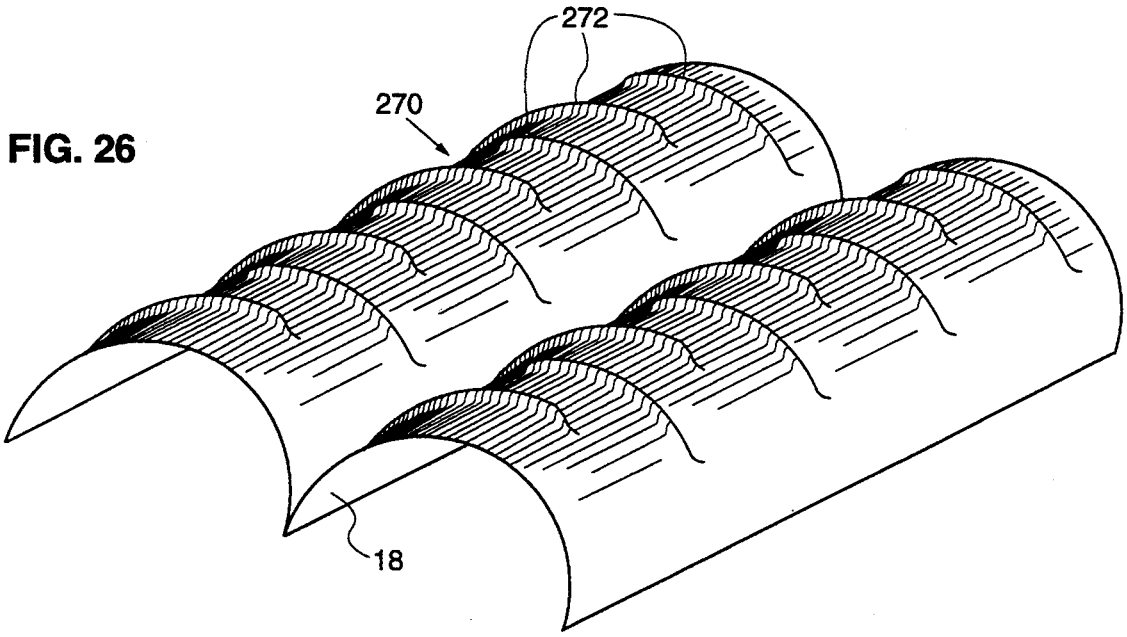
FIG. 26 is a perspective view of an alternative molded diaphragm.

Other contemplated variations are illustrated in FIGS. 24–26. FIG. 24 shows a diaphragm 256 having a plurality of parallel linear ridges 258 molded therein. Each ridge 258 spans nearly the entire distance between the central expanse 18 and one of the remote ends 244. Each ridge is gently tapered at its ends to avoid reflections of propagating waves caused by abrupt transitions.

FIG. 25 shows a diaphragm 260 having parallel ridges 264 in an alternating arrangement, with full length ridges as shown in FIG. 24 being interspersed with shorter ridges to provide a wider transitional zone between the ridge-free areas and the ridge areas. FIG. 26 shows a diaphragm 270 providing a similar effect, but with intermediate length ridges 272 of the same length being positioned alternately proximate to and distal from the central expanse 18.

Any or all of the above features and improvements may be employed in embodiments also including features of the prior transducers. For instance, the diaphragm may include support or suspension members such as elastic cords or tab cut-outs folded from the diaphragm and adhered to the magnet or frame structure. Also, the diaphragm may be formed of either single or multiple layers of different materials and may also include adhesive damping strips applied to selected regions of the diaphragm inner surface. It should also be noted that the narrow magnet spacing of the prior systems is preferred; the schematic drawings in this application show a wider magnet gap to facilitate illustration.

Having illustrated and described the principles of my invention by what is presently a preferred embodiment, it should be apparent to those persons skilled in the art that the illustrated embodiment may be modified without departing from such principles. For instance, while the contoured diaphragms of FIGS. 23–26 are illustrated in the context of monopole transducers, the contours may similarly be applied in asymmetrical, S-shaped, or dipolar transducers. The various features and improvements disclosed herein may be combined in many combinations, such as a preferred embodiment having an electrostatic drive with an S-shaped diaphragm having a small radius semi-circular front lobe and a large radius quarter-circle rear lobe, and having contours molded into the diaphragm to provide added rigidity to the rear lobe. Innumerable other permutations of the features disclosed herein are contemplated to provide alternative embodiments. I claim as my invention not only the illustrated embodiment, but all such modifications, variations and equivalents thereof as come within the true spirit and scope of the following claims.

I claim:

1. An electrostatic audio transducer comprising:

a frame;

a flexible diaphragm having first and second ends attached to the frame, the diaphragm extending along an axis of projection and having a first lobe and a second lobe each having a sectional profile, perpendicular to the axis of projection, that is at least a portion of a circle, the first and second lobes being tangentially joined to each other at a central expanse extending parallel to the axis of projection;

chargeable element attached to the central expanse parallel to the axis of protection, the chargeable element being suitable for carrying an electrostatic charge; and a conductive drive structure attached to the frame adjacent and substantially parallel to the chargeable element, the drive structure being connectable to an electrical signal to selectively attract and repel the chargeable element so as to cause movement of the central expanse in a direction perpendicular to the axis of projection and in a manner causing a rolling motion of the diaphragm, in said direction relative to the frame, sufficient to produce sound waves.

2. The transducer of claim 1 wherein the drive structure comprises a plurality of electrically conductive rods extending parallel to the chargeable element.

3. The transducer of claim 1 wherein the chargeable element comprises a linear electrically conductive rod.

4. The transducer of claim 1 wherein the chargeable element is movable, in response to electrical signals passing through the conductive drive structure, in a substantially planar path and the drive structure is positioned laterally outside of the planar path.

5. An audio transducer comprising:

a frame; and a flexible sound-producing diaphragm having first and second ends attached to the frame, the diaphragm extending along an axis of projection and having a first lobe and a second lobe each having a sectional profile, perpendicular to the axis of projection, that is at least a portion of a circle, the first and second lobes being tangentially joined to each other at a central expanse extending parallel to the axis of projection to provide the diaphragm with a substantially S-shaped sectional profile, wherein the first lobe has a first radius of curvature and the second lobe has a second radius of curvature smaller than the first radius of curvature, and the first lobe is stiffer than the second lobe sufficiently to provide a net balanced spring force to the central expanse.

* * * * *

UNITED STATES PATENT AND TRADEMARK OFFICE

CERTIFICATE OF CORRECTION

PATENT NO. : 5,450,497

DATED : September 12, 1995

INVENTOR(S) : Paul W. Paddock

It is certified that error appears in the above-identified patent and that said Letters Patent is hereby corrected as shown below:

On the Cover Page:

Under the heading "[56] References Cited - FOREIGN PATENT DOCUMENTS" insert the following:
--6094600 5/1985 Japan . . . . 381/173--.

Column 5, line 9, "0,005" should be --0.005--.

Column 5, line 11, "0,004-0,010" should be --0.004-0.010--.

Signed and Sealed this

Twenty-first Day of May, 1996

Bruce Lehman

BRUCE LEHMAN

*Commissioner of Patents and Trademarks*

*Attest:*

*Attesting Officer*